US006659207B2

(12) United States Patent
Hoffmaster et al.

(10) Patent No.: US 6,659,207 B2
(45) Date of Patent: Dec. 9, 2003

(54) BI-CENTERED DRILL BIT HAVING ENHANCED CASING DRILL-OUT CAPABILITY AND IMPROVED DIRECTIONAL STABILITY

(75) Inventors: Carl Hoffmaster, Houston, TX (US); Timothy P. Beaton, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/874,922

(22) Filed: Jun. 5, 2001

(65) Prior Publication Data

US 2002/0104688 A1 Aug. 8, 2002

Related U.S. Application Data

(63) Continuation-in-part of application No. 09/345,688, filed on Jun. 30, 1999, now Pat. No. 6,269,893.

(51) Int. Cl.[7] ..... E21B 10/40
(52) U.S. Cl. ..... 175/391; 175/399
(58) Field of Search ..... 175/385, 391, 175/399, 408

(56) References Cited

FOREIGN PATENT DOCUMENTS

| | | |
|---|---|---|
| EP | 1 039 095 A2 | 9/2000 |
| GB | 2 351 513 A | 1/2001 |

OTHER PUBLICATIONS

Great Britain Search Report dated Sep. 5, 2002.

T. M. Warren et al., "Laboratory Drilling Performance of PDC Bits", paper no. 15617, Society of Petroleum Engineers, 61st Annual Technical Conference and Exhibition of the Society of Petroleum Engineers, New Orleans, Oct. 5–8, 1986; 15 pages.

*Primary Examiner*—William Neuder
(74) *Attorney, Agent, or Firm*—Rosenthal & Osha L.L.P.

(57) ABSTRACT

A bi-center drill bit is disclosed which includes a bit body having pilot blades and reaming blades distributed azimuthally around the body. The blades have cutting elements disposed thereon at selected positions. The body and blades define a longitudinal axis of the bit and a pass-through axis of the bit. In one aspect, selected ones of the pilot blades include thereon, longitudinally between the pilot blades and the reaming blades, a pilot hole conditioning section including gage faces. The gage faces define a diameter intermediate a pilot hole diameter and a pass-through diameter defined, respectively, by the pilot blades and the reaming blades.

41 Claims, 12 Drawing Sheets

BI-CENTERED DRILL BIT HAVING ENHANCED CASING DRILL-OUT CAPABILITY AND IMPROVED DIRECTIONAL STABILITY

CROSS-REFERENCE TO RELATED APPLICATIONS

This is a continuation-in-part of application Ser. No. 09/345,688 filed on Jun. 30, 1999 now U.S. Pat. No. 6,269,893 and assigned to the assignee of the present invention.

STATEMENT REGARDING FEDERALLY SPONSORED RESEARCH OR DEVELOPMENT

Not applicable.

BACKGROUND OF INVENTION

1. Field of the Invention

The invention relates generally to the field of fixed cutter drill bits used to drill wellbores through earth formations. More specifically, the invention relates to bi-center drill bits which drill a hole larger in diameter than the diameter of an opening through which such bits may freely pass.

2. Background Art

Drill bits which drill holes through earth formations where the hole has a larger diameter than the bit's pass-through diameter (the diameter of an opening through which the bit can freely pass) are known in the art. Early types of such bits included so-called "underreamers", which were essentially a drill bit having an axially elongated body and extensible arms on the side of the body which reamed the wall of the hole after cutters on the end of the bit had drilled the earth formations. Mechanical difficulties with the extensible arms limited the usefulness of underreamers.

More recently, so-called "bi-centered" drill bits have been developed. A typical bi-centered drill bit includes a "pilot" section located at the end of the bit, and a "reaming" section which is typically located at some axial distance from the end of the bit (and consequently from the pilot section). One such bi-centered bit is described in U.S. Pat. No. 5,678,644 issued to Fielder, for example. Bi-centered bits drill a hole larger than their pass through diameters because the axis of rotation of the bit is displaced from the geometric center of the bit. This arrangement enables the reaming section to cut the wall of the hole at a greater radial distance from the rotational axis than is the radial distance of the reaming section from the geometric center of the bit. The pilot section of the typical bi-centered bit includes a number of PDC cutters attached to structures ("blades") formed into or attached to the end of the bit. The reaming section is, as already explained, typically spaced axially away from the end of the bit, and is also located to one side of the bit. The reaming section also typically includes a number of PDC inserts on blades on the side of the bit body in the reaming section.

Limitations of the bi-centered bits known in the art include the pilot section being axially spaced apart from the reaming section by a substantial length. FIG. 1 shows a side view of one type of bi-center bit known in the art, which illustrates this aspect of prior art bi-center bits. The bi-center bit 101 includes a pilot section 106, which includes pilot blades 103 having PDC inserts 110 disposed thereon, and includes gauge pads 112 at the ends of the pilot blades 103 axially distant from the end of the bit 101. A reaming section 107 can include reaming blades 111 having PDC inserts 105 thereon and gauge pads 117 similar to those on the pilot section 106. In the bi-center bit 101 known in the art, the pilot section 106 and reaming section are typically separated by a substantial axial distance, which can include a spacer or the like such as shown at 102. Spacer 102 can be a separate element or an integral part of the bit structure but is referred to here as a "spacer" for convenience. As is conventional for drill bits, the bi-center bit 101 can include a threaded connector 104 machined into its body 114. The body 114 can include wrench flats 115 or the like for make up to a rotary power source such as a drill pipe or hydraulic motor.

An end view of the bit 101 in FIG. 1 is shown in FIG. 2. The blades 108A in the pilot section and the blades 111B in the reaming section are typically straight, meaning that the cutters 110 are disposed at substantially the same relative azimuthal position on each blade 108A, 111B. In some cases, the blades 108A in the pilot section 106 may be disposed along the same azimuthal direction as the blades 111B in the reaming section 110.

Prior art bi-center bits are typically "force-balanced"; that is, the lateral force exerted by the reaming section 110 during drilling is balanced by a designed-in lateral counter-force exerted by the pilot section 106 while drilling is underway. However, the substantial axial separation between the pilot section 106 and the reaming section 110 results in a turning moment against the axis of rotation of the bit, because the force exerted by the reaming section 110 is only balanced by the counterforce (exerted by pilot section 106) at a different axial position. This turning moment can, among other things, make it difficult to control the drilling direction of the hole through the earth formations.

Still another limitation of prior art bi-centered bits is that the force balance is calculated by determining the net vector sum of forces on the reaming section 110, and designing the counterforce at the pilot section 106 to offset the net vector force on the reaming section without regard to the components of the net vector force originating from the individual PDC inserts. Some bi-center bits designed according to methods known in the art can have unforeseen large lateral forces, reducing directional control and drilling stability.

A bi-center bit such has shown in U.S. patent application Ser. No. 09/345,688 filed on Jun. 30, 1999 and assigned to the assignee of the present invention avoids a number of limitations of prior art bi-center drill bits. It has been observed, however, that even these bi-center bits are subject to "dropping angle" during directional drilling operations, meaning that they have a tendency to turn the direction of a directionally drilled wellbore back toward vertical. Further, some of the cutting elements on these bits may move in a direction counter to the direction of rotation of the bit about its "pass-through" axis when the bit is used to drill out float equipment and is thus constrained to rotate in an opening having about the "pass-through" diameter of the bit.

SUMMARY OF INVENTION

One aspect of the invention is a bi-center drill bit including a bit body having pilot blades and reaming blades thereon distributed azimuthally around the bit body. Selected ones of the blades have cutting elements attached to them at selected locations. Selected ones of the blades include, longitudinally between the pilot blades and the reaming blades, a pilot hole conditioning section. The pilot hole conditioning section on each of the selected blades includes a gage face. The gage faces together define a diameter intermediate a pilot hole diameter and a pass-through diameter defined, respectively, by the pilot blades and the reaming blades.

Another aspect of the invention is a bi-center bit having at least one cutting element disposed in a portion of a pilot section thereof which has a cutting surface oriented to cut earth formation when moving in a direction substantially opposite a direction of rotation of the bit.

Other aspects and advantages of the invention will be apparent from the following description and the appended claims.

DETAILED DESCRIPTION

Figure 1:
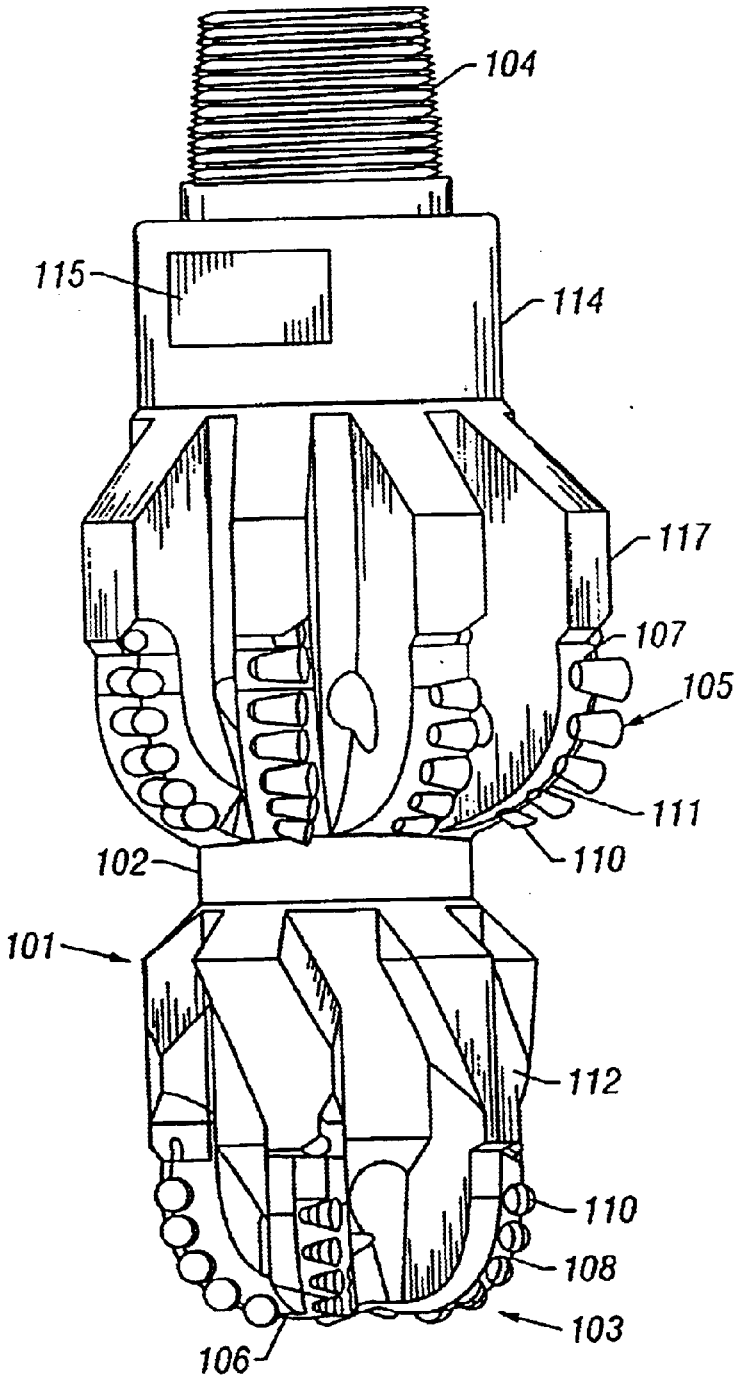
FIG. 1 (Prior Art)
FIG. 1 shows a side view of a prior art bi-center drill bit.
Figure 2:
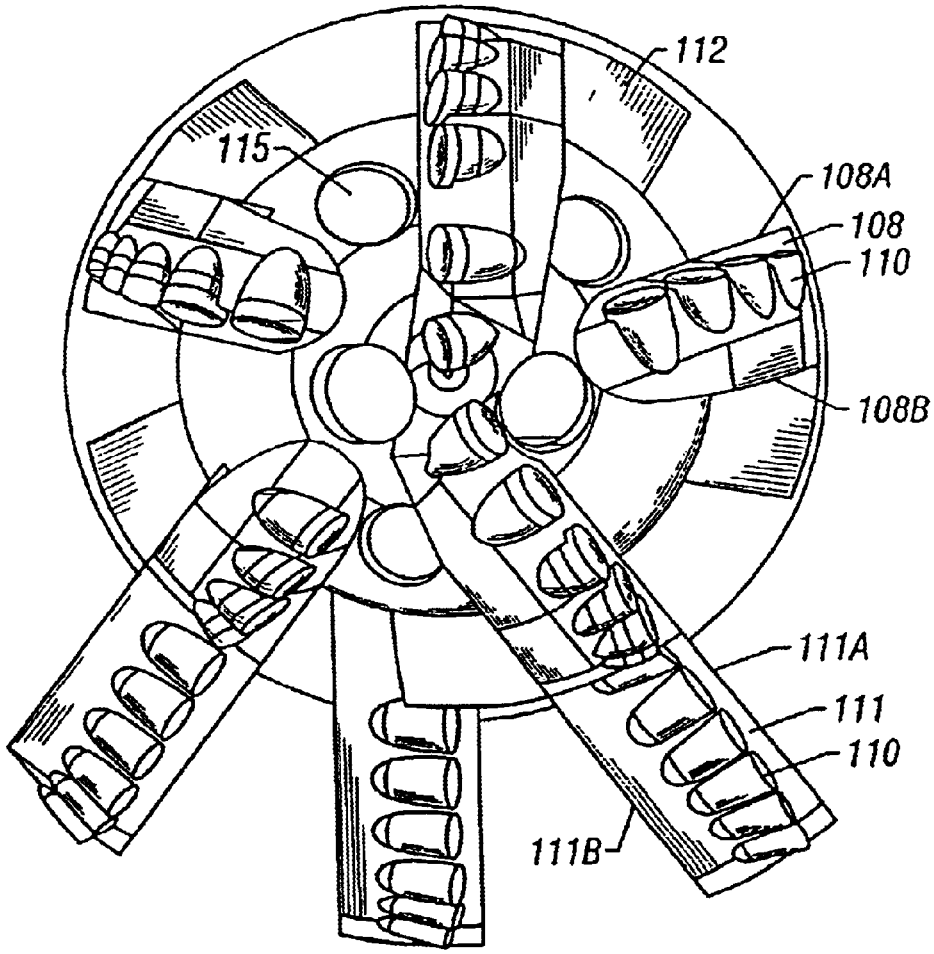
FIG. 2 (Prior Art)
FIG. 2 shows an end view of a prior art bi-center drill bit.
Figure 3:
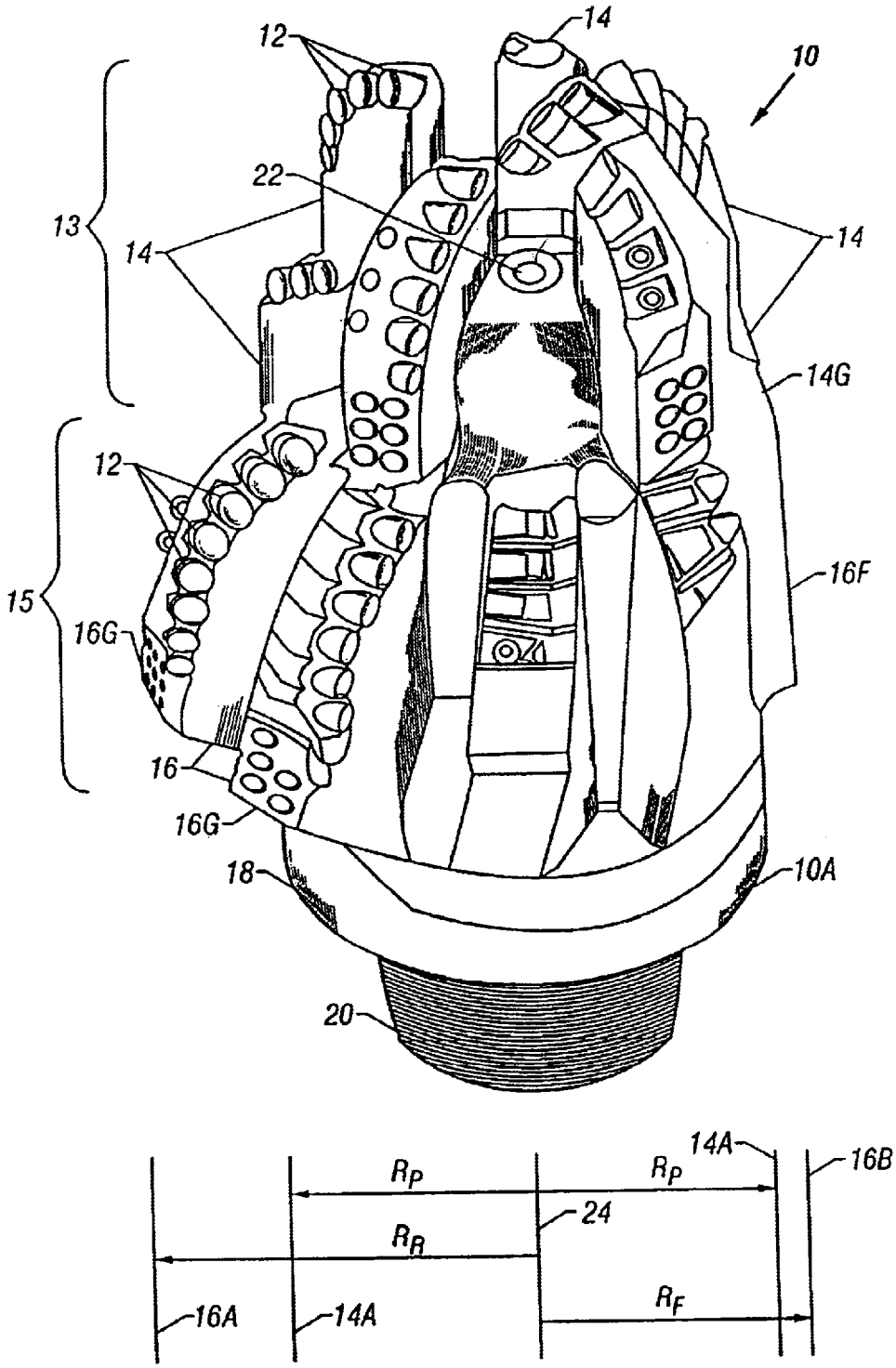
FIG. 3 shows an oblique view of one embodiment of a bi-center drill bit.

An example of a bi-center drill bit is shown in oblique view in FIG. 3. A bi-center drill bit 10 includes a body 18 which can be made from steel or other material conventionally used for drill bit bodies. One end of the body 18 can include thereon a threaded connection 20 for attaching the bit 10 to a source of rotary power, such as a rotary drilling rig (not shown) or hydraulic motor (not shown) so that the bit 10 can be turned to drill earth formations (not shown).

At the end of the body 18 opposite the threaded connection 20 is a pilot section 13 of the bit 10. The pilot section 13 can include a set of azimuthally spaced apart blades 14 affixed to or otherwise formed into the body 18. On each of the blades 14 is mounted a plurality of polycrystalline diamond compact (PDC) inserts, called cutters, such as shown at 12. The pilot blades 14 typically each extend laterally from the longitudinal axis 24 of the bit 10 by the same amount. The pilot section 13 thus has a drilling radius, which can be represented by $R_P$ (14A in FIG. 3) of about the lateral extent of the pilot blades 14. The radially outermost surfaces of the pilot blades 14 generally conform to a circle which is substantially coaxial with the longitudinal axis 24 of the bit 10. When the bit 10 is rotated about its longitudinal axis 24, the pilot section 13 will thus drill a hole having a diameter about equal to $2\times R_P$. The pilot hole diameter can be maintained by gauge pads such as shown in FIG. 3 at 14G, disposed on the radially (laterally) outermost portion of the pilot blades 14.

A reaming section 15 is positioned on the body 18 axially spaced apart from the pilot section 13. The reaming section 15 can also include a plurality of blades 16 each having thereon a plurality of PDC cutters 12. The reaming blades 16 can be affixed to or formed into the body 18 just as the pilot blades 14. It should be understood that the axial spacing referred to between the pilot section 13 and the reaming section 15 denotes the space between the axial positions along the bit 10 at which actual cutting of earth formations by the bit 10 takes place. It should not be inferred that the pilot section 13 and reaming section 15 are physically separated structures, for as will be further explained, one advantageous aspect of the invention is a unitized spiral structure used for selected ones of the blades 14, 16. Some of the blades 16 in the reaming section 15 extend a maximum lateral distance from the rotational axis 24 of the bit 10 which can be represented by $R_R$ (16A in FIG. 3), and which is larger than $R_P$.

The bit 10 shown in FIG. 3 has a "pass-through" diameter (the diameter of an opening through which the bit 10 will fit), which, as will be further explained, results from forming the reaming blades 16 to conform to a circle having the pass-through diameter. The center of the pass through circle, however, is offset from the longitudinal axis 24 of the bit. As a result of forming the blades 16 to conform to the axially offset pass-through circle, some of the reaming blades 16, such as shown at 16F in FIG. 3, will not extend laterally from the axis 24 as much as the other reaming blades. The laterally most extensive ones of the reaming blades 16 thus formed can include gauge pads such as shown at 16G. During drilling, as the bit 10 is rotated about the longitudinal axis 24, the hole which is drilled by the reaming section 15 will have a diameter about equal to $2\times R_R$ as the blades 16 in the reaming section 15 which extend the full lateral distance $R_R$ from the longitudinal axis 24 rotate about the longitudinal axis 24.

The bit 10 includes a plurality of jets, shown for example at 22, the placement and orientation of which will be further explained.

In one aspect of the invention, it has been determined that a bi-center bit can effectively drill a hole having the expected drill diameter of about $2\times R_R$ even while the pilot section 13 axial length ($L_p$ in FIG. 5) is less than about 80 percent of the diameter of the pilot section ($2\times R_P$). The pilot section length ($L_p$ in FIG. 5) is defined herein as the length from the end of the bit 10 to the top of the reaming section 15. In this example, the bit 10 also has an overall axial make-up length (measured from the end of the bit to a make up shoulder 10A) which is less than about 133 percent of the drilling diameter of the bit ($2\times R_R$). Prior art bi-center bits have pilot section axial lengths substantially more than the 80 percent length-to-diameter of the bit 10 of this invention. It has been determined that drilling stability of a bi-center bit is not compromised by shortening the pilot section axial length and overall axial make-up length of the bit in accordance with the invention.

Conversely, it should be noted that the reaming section 15 necessarily exerts some lateral force, since the blades 16 which actually come into contact with the formation (not shown) during drilling are located primarily on one side of the bit 10. The lateral forces exerted by all the PDC cutters 12 are balanced in the bit of this invention in a novel manner which will be further explained. However, as a result of any form of lateral force balancing between the pilot section 13 and the reaming section 15, the pilot section 13 necessarily exerts, in the aggregate, a substantially equal and azimuthally opposite lateral force to balance the lateral force exerted by the reaming section 15. As will be appreciated by those skilled in the art, the axial separation between the lateral forces exerted by the reaming section 15 and the pilot section 13 results in a turning moment being developed normal to the axis 24. The turning moment is proportional to the magnitude of the lateral forces exerted by the reaming section 15 and the pilot section 13, and is also proportional to the axial separation of the reaming section 15 and the pilot section 13. In this aspect of the invention, the axial separation of the pilot section 13 and the reaming section is kept to a minimum value by having a pilot section length 13 and overall length as described above. By keeping the axial separation to a minimum, the turning moment developed by the bit 10 is minimized, so that drilling stability can be improved.

In another aspect of the invention, it has been determined that the drilling stability of the bi-center bit 10 can be improved when compared to the stability of prior art bi-center bits by mass-balancing the bit 10. It has been determined that the drilling stability will improve a substantial amount when the bit 10 is balanced so its center of gravity is located within about 2.5 percent of the drill diameter of the bit ($2\times R_R$) from the axis of rotation 24. Prior art bi-center bits were typically not mass balanced at all. Mass balancing can be performed, among other ways, by locating the blades 14, 16 and selecting suitable sizes for the blades 14, 16, while taking account of the mass of the cutters 12, so as to provide the preferred mass balance. Alternatively, gauge pads, or other extra masses, can be added as needed to achieve the preferred degree of mass balance. Even more preferable for improving the drilling performance of the bit 10 is mass balancing the bit 10 so that its center of gravity is within 1.5 percent of the drill diameter of the bit 10.

In another aspect of the invention, it has been determined that the drilling stability of a bi-center bit can be further improved by force balancing the entire bit 10 as a single structure. Force balancing is described, for example, in, T. M. Warren et al., *Laboratory Drilling Performance of PDC Bits,* paper no. 15617, Society of Petroleum Engineers, Richardson, Tex., 1986. Prior art bi-center bits were force balanced, but in a different way. In this embodiment of the invention, the forces exerted by each of the PDC cutters 12 can be calculated individually, and the locations of the blades and the PDC cutter 12 thereon can be selected so that the sum of all the forces exerted by each of the cutters 12 will have a net imbalance of less than about 10 percent of the total axial force exerted on the bit (known in the art as the "weight on bit"). The designs of both the pilot section 13 and the reaming section 15 are optimized simultaneously in this aspect of the invention to result in the preferred force balance. An improvement to drilling stability can result from force balancing according to this aspect of the invention because the directional components of the forces exerted by each individual cutter 12 are accounted for. In the prior art, some directional force components, which although summed to the net lateral force exerted individually by the reaming section and pilot section, can result in large unexpected side forces when the individual cutter forces are summed in the aggregate in one section of the bit to offset the aggregate force exerted by the other section of the bit. This aspect of the invention avoids this potential problem of large unexpected side forces by providing that the locations of and shapes of the blades 14, 1 and cutters 12 are such that the sum of the forces exerted by all of the PDC cutters 12, irrespective of whether they are in the pilot section 13 or in the reaming section 15, is less than about 10 percent of the weight on bit. It has been determined that still further improvement to the performance of the bit 10 can be obtained by balancing the forces to within 5 percent of the axial force on the bit 10.

Figure 4:
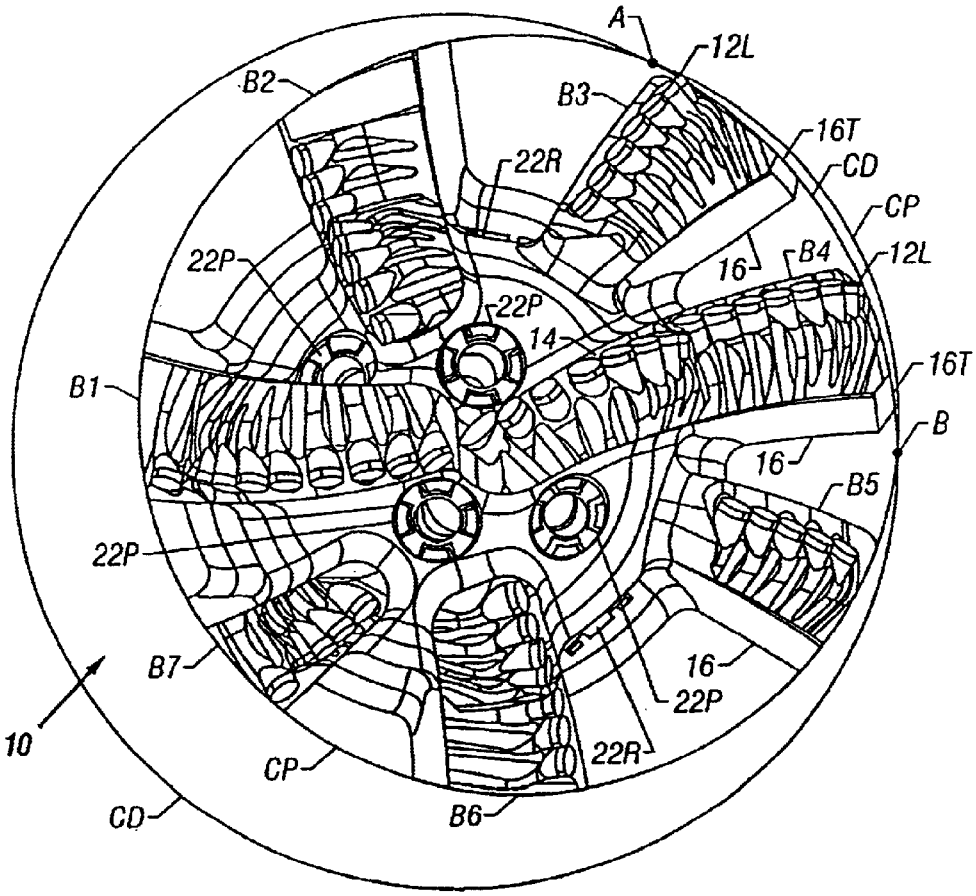
FIG. 4 shows an end view of one embodiment of the drill bit of FIG. 3.

An end view of this embodiment of the invention is shown in FIG. 4 which illustrates several features intended to improve drilling stability of the bi-center bit 10. The blades 14 in the pilot section (13 in FIG. 3) are shown azimuthally spaced apart. Each pilot section blade 14 is preferably shaped substantially in the form of a spiral. The spiral need not conform to any specific spiral shape, but only requires that the blade be shaped so that the individual cutters (12 in FIG. 3) on each such spirally shaped blade are at different azimuthal positions with respect to each other. Although the example shown in FIG. 4 has every blade being spirally shaped, it is within the contemplation of this invention that only selected ones of the blades can be spiral shaped while the other blades may be straight. Each cutter on such straight blades may be at the same azimuthal position.

In another aspect of the invention, selected ones of the pilot blades 14 can be formed into the same individual spiral structure as a corresponding one of the reaming blades 16. This type of unitized spiral blade structure is used, for example, on the blades shown at B2, and B4 in FIG. 4. The reaming section 15 may include blades such as shown at B3, B5 and B6 in FIG. 4 which are not part of the same unitized spiral structure as a pilot blade 14, because there is no corresponding pilot blade 14 at the same azimuthal position as these particular reaming blades B3, B5, B6. It has been determined that having blades such as B2 and B4 shaped substantially as a unitized spiral structure, encompassing both the pilot blade 14 and the azimuthally corresponding reaming blade 16, improves the drilling stability of the bit 10 when compared to the stability of bi-center bits using straight-blades and/or non-unitized pilot/reaming blades as previously known in the art.

Also shown in FIG. 4 are the previously referred to jets, in both the pilot section, shown at 22P, and in the reaming section, shown at 22R. In another aspect of this invention, it has been determined that cuttings (not shown) generated by the bit 10 as it penetrates rock formations (not shown) are more efficiently removed from the drilled hole, and hydraulic power used to pump drilling fluid (not shown) through the jets 22P, 22R is spent more efficiently, when the reaming jets 22R are oriented so that their axes are within about 30 degrees from a line normal to the axis (24 in FIG. 3) of the bit 10. Prior art bi-center bits typically include reaming jets which are oriented so that their axes are in approximately the same directions as the pilot jets, this being generally in the direction along which the bit drills. Other prior art bits have reaming jets which discharge directly opposite the direction of the bottom of the drilled hole. Either type of reaming jet previously known in the art has reduced hydraulic performance as compared to the bi-center bit of this aspect of the invention. It has been determined that the performance of the reaming jets 22R can be improved still further by orienting them so that their axes are within 20 degrees of a line normal to the longitudinal axis 24.

Another advantageous aspect of the invention is the shape of the reaming blades 16 and the positions of radially outermost cutters, such as shown at 12L, disposed on the reaming blades 16. In making the bit according to this aspect of the invention, the outer surfaces of the reaming blades 16 can first be cut or otherwise formed so as to conform to a circle having the previously mentioned drill diameter ($2\times R_R$). This so-called "drill circle" is shown in FIG. 4 at CD. The drill circle CD is substantially coaxial with the longitudinal axis (24 in FIG. 3) of the bit 10. In FIG. 4, the previously referred to pass-through circle is shown at CP. The outer surfaces of the reaming blades 16, after being formed to fit within the drill circle CD, can then be cut or otherwise formed to conform to the pass-through circle CP. The pass-through circle CP is axially offset from the drill circle CD (and the longitudinal axis 24) by an amount which results in some overlap between the circumferences of pass through circle CP and the drill circle CD. The intersections of the pass-through circle CP and drill circle CD circumferences are shown at A and B in FIG. 4.

The radially outermost cutters 12L can then be positioned on the leading edge (the edge of the blade which faces the direction of rotation of the bit) of the radially most extensive reaming blades, such as shown at B3 and B4 in FIG. 4, so that the cutter locations will trace a circle having the full drill diameter ($2\times R_R$) when the bit rotates about the longitudinal axis 24. The radially most extensive reaming blades B3, B4, however, are positioned azimuthally between the intersections A, B of the drill circle CD and the pass through circle CP. The drill circle CD defines, with respect to the longitudinal axis 24, the radially outermost part of the bit at every azimuthal position. The reaming blades 16 are generally made to conform to the pass-through circle CP; however, the reaming blades B3, B4 located between intersections A and B will be formed to conform to the drill circle CD, because the drill circle CD therein defines the radially outermost extension of any part of the bit 10. Between intersections A and B, the drill circle CD is radially closer to the longitudinal axis 24 than is the pass-through circle CP, therefore the blades B3, B4 within the arcuate section between intersections A and B will extend only as far laterally as the radius of the drill circle CD. As shown in FIG. 4, the radially outermost cutters 12L on blades B3 and B4 can be positioned at "full gauge", meaning that these cutters 12L are at the same radial distance from the axis 24 as the outermost parts of the blade B3, B4 onto which they are attached. However, the cutters 12L on blades B3, B4 are also disposed radially inward from the pass-through circle CP at the same azimuthal positions because of the limitation of the lateral extent of these blades B3, B4. Therefore, the outermost cutters 12L will not contact the inner surface of an opening having a diameter about equal to the pass-through diameter as the bit 10 is moved through such an opening. When rotated about the longitudinal axis 24, however, the bit 10 will drill a hole having the full drill diameter ($2\times R_R$). The preferred shape of the radially outermost reaming blades B3, B4 and the position of radially outermost cutters 12L thereon enables the bit 10 to pass freely through a protective casing (not shown) inserted into a wellbore, without sustaining damage to the outermost cutters 12L, while at the same time drilling a hole which has the full drill diameter ($2\times R_R$).

The reaming blades which do not extend to full drill diameter (referred to as "non-gauge reaming blades"), shown for example at B1, B2, B5, B6 and B7, have their outermost cutters positioned radially inward, with respect to pass-through circle CP, of the radially outermost portion of each such non-gauge reaming blade B1, B2, B5, B6 and B7 to avoid contact with any part of an opening at about the pass-through diameter. This configuration of blades and cutters has proven to be particularly useful in efficiently drilling through equipment (called "float equipment") used to cement in place the previously referred to casing. By positioning the cutters 12 on the non-gauge reaming blades as described herein, damage to these cutters 12 can be avoided. Damage to the casing can be also be avoided by arranging the cutters 12 as described, particularly when drilling out the float equipment. Although the non-gauge reaming blades B1, B2, B5, B6 and B7 are described herein as being formed by causing these blades to conform to the pass-through circle CP, it should be understood that the pass-through circle only represents a radial extension limit for the non-gauge reaming blades B1, B2, B5, B6 and B7. It is possible to build the bit 10 with radially shorter non-gauge reaming blades. However, it should also be noted that by having several azimuthally spaced apart non-gauge reaming blades which conform to the pass-through circle CP, the likelihood is reduced that the outermost cutters 12L on the gauge reaming blades B3, B4 will contact any portion of an opening, such as a well casing, less than the drill diameter.

It should also be noted that the numbers of gauge and non-gauge reaming blades shown in FIG. 4 is only one example of numbers of gauge and non-gauge reaming blades. It is only required in this aspect of the invention that the gauge reaming blades conform to the drill circle CD, where the drill circle is less radially extensive than the pass-through circle CP to be able to locate the outermost cutters 12L at full gauge as in this aspect of the invention. It is also required that all the reaming blades conform to the radially least extensive of the drill circle CD and pass-through circle CP at any azimuthal blade position.

Figure 5:
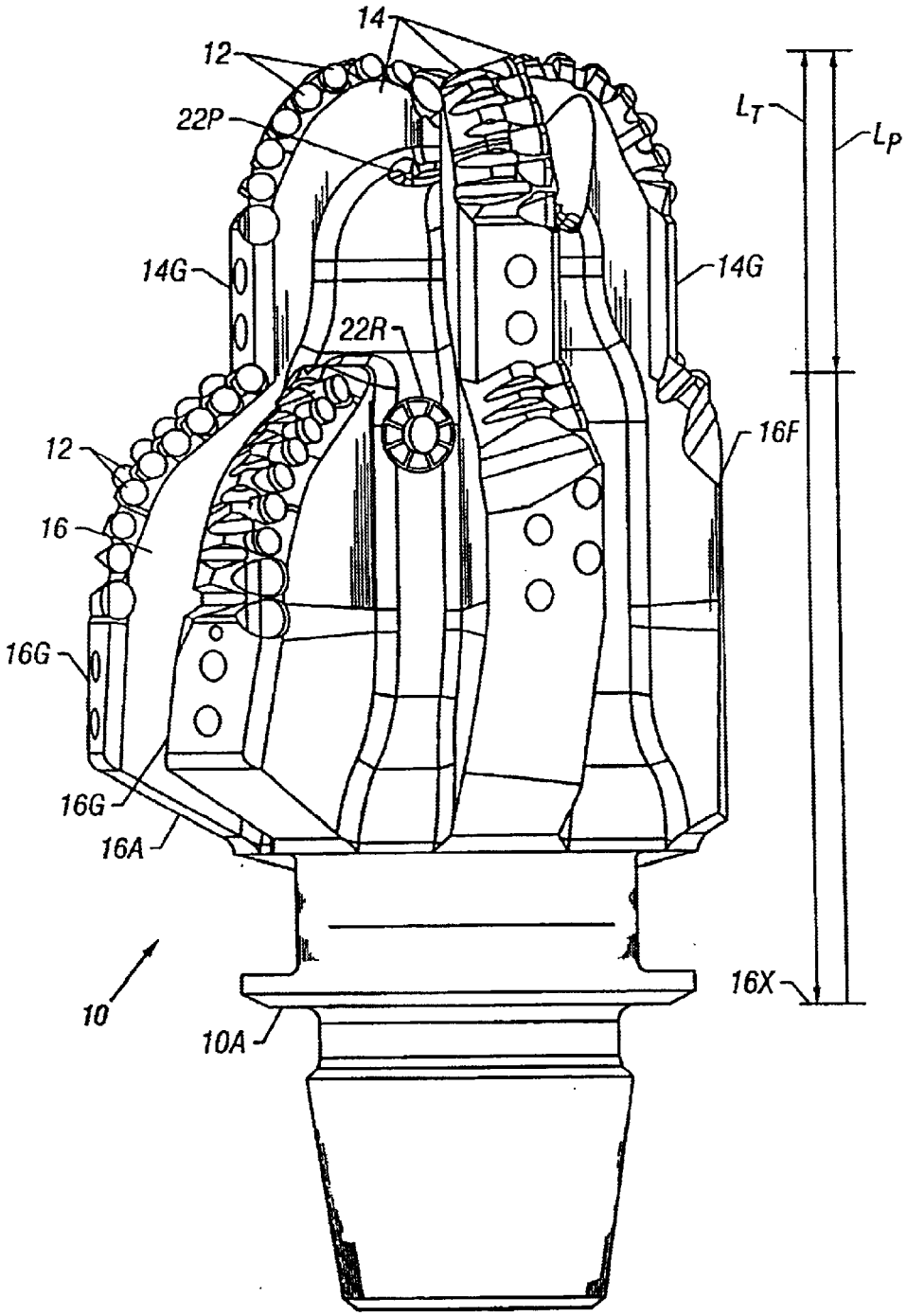
FIG. 5 shows a side view of one embodiment of a bi-center drill bit.

FIG. 5 shows a side view of this embodiment of the invention. As previously explained, the pilot section (13 in FIG. 3) can have an overall length, $L_p$, which is less than about 80 percent of the drill diameter of the pilot section (13 in FIG. 3). The overall make-up length, $L_T$, shown at 16X in FIG. 5, extending from the end of the bit to a make-up shoulder 10A, in this embodiment of the invention can be less than about 133 percent of the drill diameter of the bit 10. The gauge pads for the pilot section blades 14 are shown in FIG. 5 generally at 14G. The gauge pads for the reaming section blades 16 are shown generally at 16G.

Figure 6:
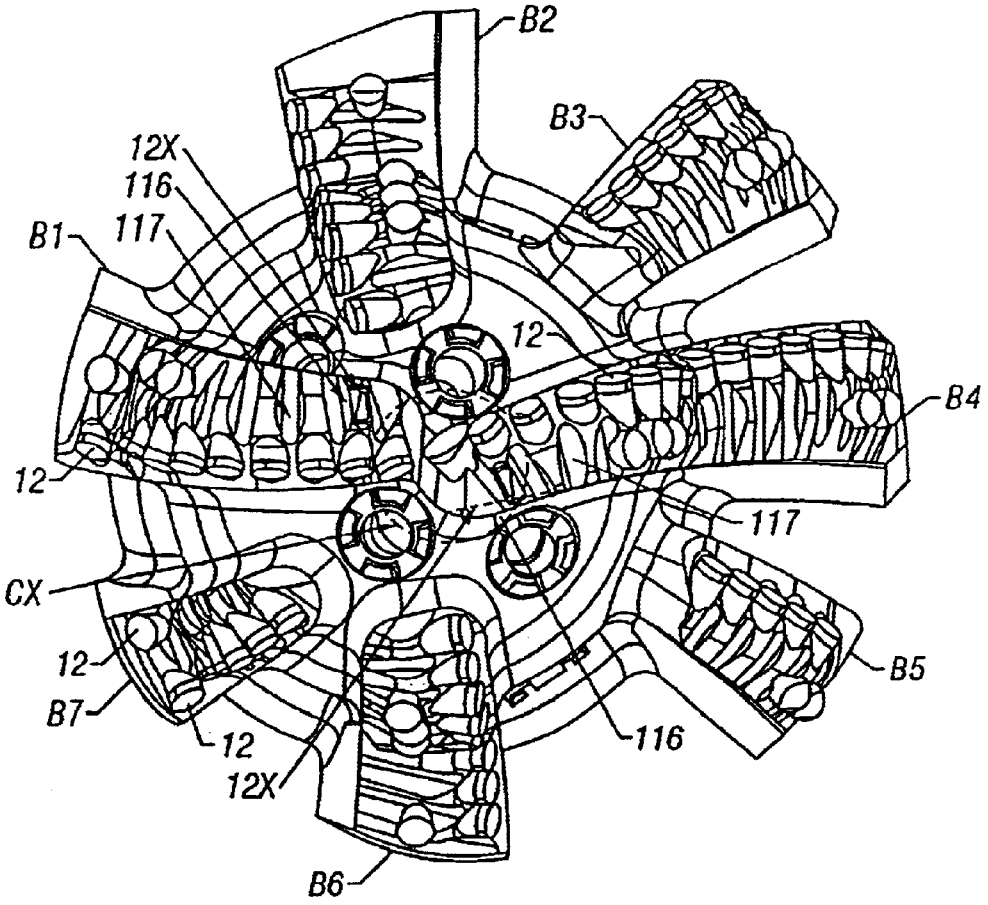
FIG. 6 shows an end view of one embodiment of the bit wherein additional cutters are attached to pilot blades near a precession circle.

A bi-center bit can be modified to improve its performance, particularly where the bit is used to drill through the previously mentioned float equipment (this drilling operation is referred to in the art as "drill out"). During such operations as drill out, a bi-center bit will rotate with a precessional motion which generally can be described as rotating substantially about the axis of the pass through circle, while the longitudinal axis 24 generally precesses about the axis of the pass through circle (CP in FIG. 4). This occurs because the bit is constrained during drill out to rotate within an opening (the interior of the casing) which is at, or only slightly larger than, the pass-through diameter of the bit. Referring to FIG. 6, the precessional motion of the longitudinal axis (24 in FIG. 3) about the pass-through circle axis defines a circle CX (hereinafter called a "precession circle") having a radius about equal to the offset between the longitudinal axis (24 in FIG. 3) and the axis of the pass through circle (CP in FIG. 4). The improvements to the drill bit in this aspect of the invention includes increasing the thickness of the blades, particularly in the vicinity of the precession circle CX. These thickened areas are shown at 116 on blades B1 and B4. As shown in FIG. 6, blades B1 and B4 can be the previously described unitized spiral structures forming both a reaming and pilot blade, although this is not to be construed as a limitation on the invention. The thickened blade areas 116 can be formed on any blade in the part of the blade proximate to the precession circle CX. The thickened blade areas 116 can be used to mount additional cutters, shown at 12X. The additional cutters 12X can be PDC inserts as are the other cutters 12, or can alternatively be tungsten carbide or other diamond cutters known in the art. Tungsten carbide cutters provide the advantage of relatively rapid wear down. The wear down, if it takes place during drill out, will leave the bi-center bit after drill out with a cutter configuration as shown in FIG. 4 (which excludes the additional cutters 12X), which configuration is well suited for drilling earth formations. In the vicinity of the precession circle CX the additional cutters 12X and the other cutters 12 can be mounted on the blades B1, B4 at a different back rake and/or side rake angle than are the cutters 12 away from the precession circle CX to reduce damage to the cutters 12, 12X during drill out.

Another aspect of the additional cutters 12X and the other cutters 12 proximate to the precession circle CX is that they can be mounted in specially formed pockets in the blade surface, such as shown at 117, which have greater surface area to contact the individual cutters 12, 12X than do the pockets which hold the other cutters 12 distal from the precession circle CX, so that incidence of the cutters 12, 12X proximate to the precession circle CX breaking off during drilling can be reduced, or even eliminated.

Figure 7:
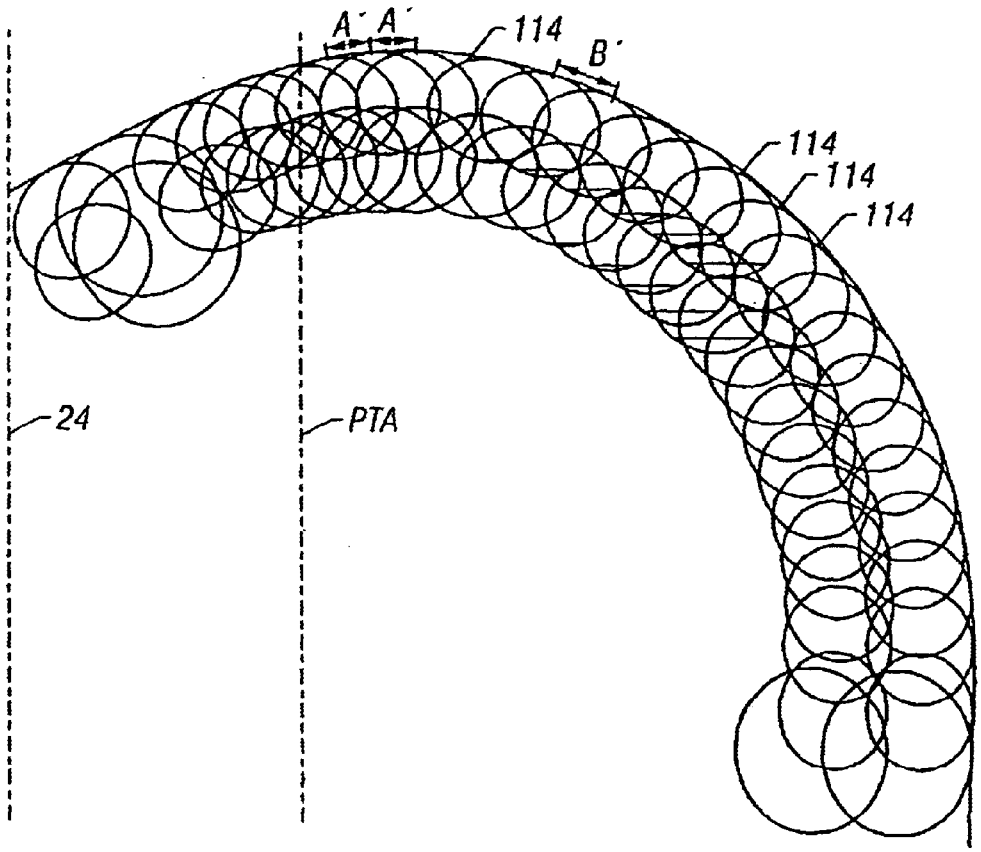
FIG. 7 shows a side view of locations of cutters on one of the blades in the embodiment of the bit shown in FIG. 6.

Referring to FIG. 7, another aspect of this invention is shown which can improve drilling performance of the bi-center bit, particularly during drill out. FIG. 7 shows a side profile view of the locations of cutters on the pilot blades (14 in FIG. 3). The positions of the cutters (12, 12X in FIG. 6) along the blade are shown by circles 114. In this aspect of the invention, the improvement is to include a greater volume of diamond per unit length of the blade in areas such as shown at A' in FIG. 7 than at other locations, such as at B', further away from the pass-through circle axis PTA. The increased diamond volume per unit blade length preferably is proximate to the pass-through circle axis PTA in FIG. 7.

The increased diamond volume can be provided by several different techniques. One such technique includes mounting additional cutters in a row of such additional cutters located azimuthally spaced apart from the other cutters on the same blade. This would be facilitated by including pockets therefor, such as at 117 in FIG. 6 in thickened areas on the blade (such as 116 in FIG. 6). Other ways to increase the diamond volume per unit length include increasing the number of cutters (12 in FIG. 6) per unit length along each blade. Still another way to increase the diamond volume would be to increase the thickness of the diamond "table" on the cutters proximate to the pass-through axis. Irrespective of how the diamond volume is increased, or irrespective of the ultimate cutter density selected near the pass-through axis PTA, the cutter forces and the mass of the bit are preferably balanced by the methods described earlier herein.

The bi-center drill bit described herein is particularly well suited for drill out of the float equipment used to cement a casing in a wellbore. To drill out using the bi-center bit of this invention, the bit is rotated within the casing while applying force along the longitudinal axis (24 in FIG. 3) to drill through the cement and float equipment at the bottom of the casing. While constrained within the casing (not shown), the reaming blades (16 in FIG. 3) are constrained to rotate substantially about the pass-through axis PTA because the reaming blades conform to the pass-through circle (CP in FIG. 4). The radially most extensive reaming blades do not contact the casing during drill out because they are located in the arcuate section where the drill circle (CD in FIG. 4) is radially less extensive than the pass through circle (CP in FIG. 4). As the float equipment is fully penetrated, and the bit leaves the casing, the bit will then rotate about the longitudinal axis (24 in FIG. 3) so that the hole drilled will have the full drill diameter.

Figure 8:
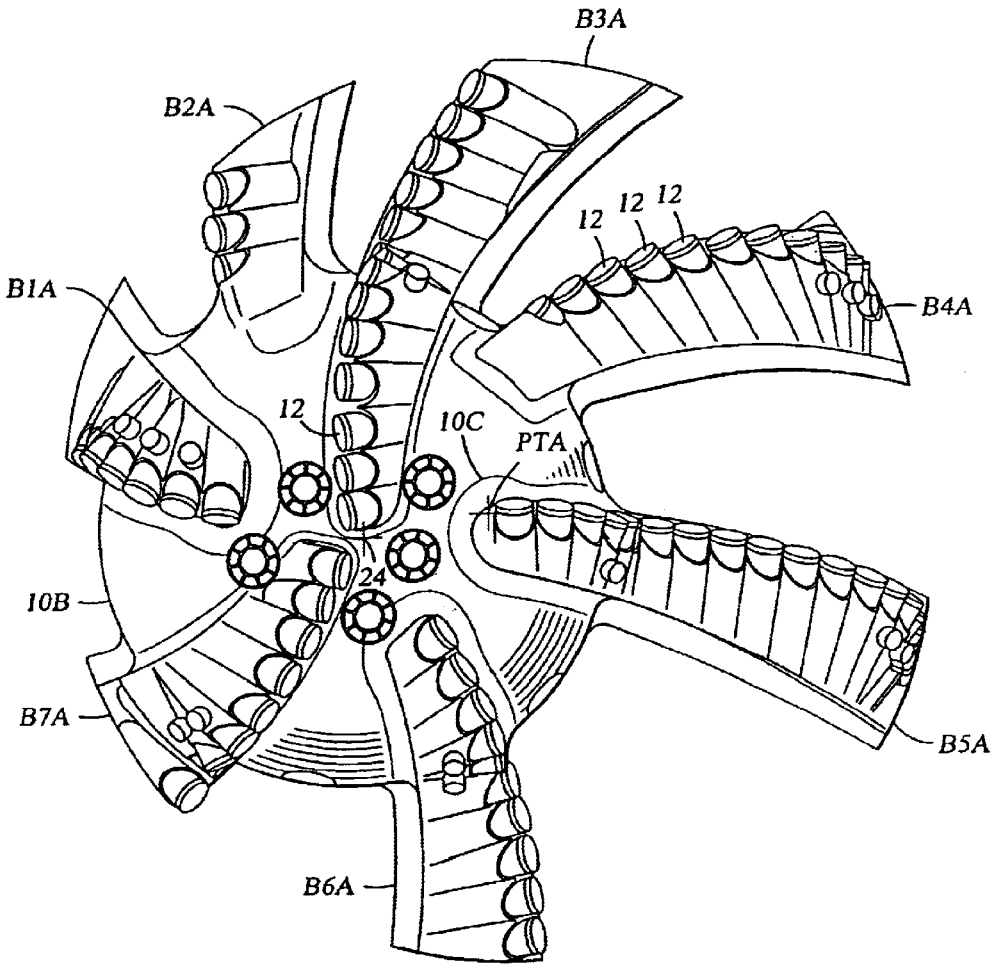
FIG. 8 illustrates an area on a bi-center bit susceptible to reverse rotation during drill out of a casing.

An improvement to the drill out capability for a bi-center drill bit as described above can be explained by referring to FIG. 8. The example in FIG. 8, generally at 10B, includes blades B1A–B7A similar in configuration to the blades of the previous embodiments (for example B1–B7 in FIG. 4). In the embodiment of FIG. 8, blades B4A and B5A are disposed within the arcuate section (A–B in FIG. 4) and are shaped generally to conform to the drill circle (CD in FIG. 4). Blades B1A–B3A, B6A and B7A generally conform at their outermost lateral extent to the pass-through circle (CP in FIG. 4). In the embodiment of FIG. 8, blades B6A and B3A extend laterally inward (in the pilot section) to about the position of the longitudinal axis 24 of the bit so that the pilot hole will be properly drilled. In the embodiment shown in FIG. 4, for example, the corresponding blades extending inward to about the axis 24 include blades B1 and B4. The blades shown in FIG. 8, however, are arranged so that substantially no cutting elements are disposed proximate a line 10C which extends between the longitudinal axis 24 and the pass-through axis PTA. When a bi-center bit is rotated inside an opening having a diameter about equal to the pass-through diameter, it rotates about the pass through axis PTA, as previously explained. By arranging the blades B1A–B7A such as shown in FIG. 8 to avoid having cutting elements proximate the line 10C, reverse-rotating cutting elements are avoided when the bit rotates about the pass through axis PTA. For purposes of the various embodiments of the invention, the expression "proximate the line 10C" further includes within its scope an area roughly defined by a triangle including as two of its sides lines extending from the pass-though axis PTA at an angle of about 45 degrees from the line 10C. The third side of the triangle intersects these lines and the longitudinal axis of the bit 24. The area within this triangle is susceptible to reverse rotation when the bit is rotated about the pass-through axis PTA.

Figure 10:
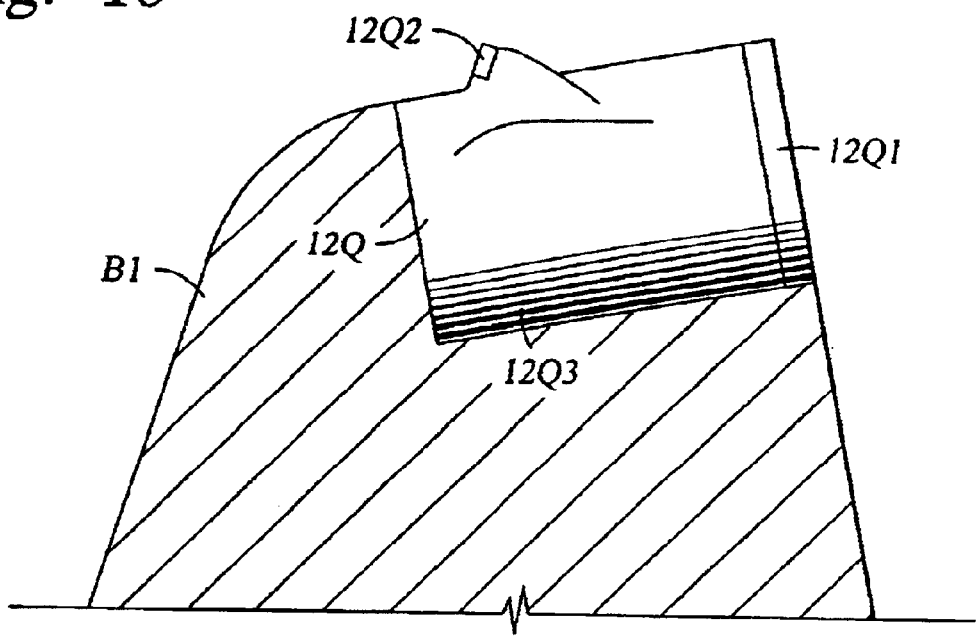
FIG. 10 shows an example of a "seesaw", or bidirectional cutter which may be used in some embodiments of a bi-center drill bit.

In some cases, and according to one aspect of the invention, it may be advantageous to arrange some of the blades on the pilot section to extend to a position proximate to the line (10C in FIG. 8), as defined above. This arrangement of pilot blades and cutting elements thereon is shown in FIG. 4, as previously explained. As explained with respect to the example bit shown in FIG. 8, however, any cutting elements disposed proximate to the line 10C may rotate in a direction opposite to the direction of rotation of the bit when the bit is constrained to rotate within an opening having a diameter about the same as the pass through diameter, and therefore about the pass-through axis PTA. In such cases where the pilot blades are arranged to include cutting elements proximate the line 10C, such as the arrangement in FIG. 4, a particular type of cutting element may improve the ability to drill out casing. An example of such a special cutting element is shown in FIG. 10. The special cutting element 12Q is affixed to the blade B1 in a position proximate the line (10C in FIG. 8). The special cutting element 12Q includes a substrate 12Q3 made in any manner as is conventional for making PDC cutting element substrates, and a primary diamond table 12Q1 affixed thereto in an orientation adapted to cut earth formation as the bit is rotated so that the special cutting element 12Q moves along the direction of rotation. The special cutting element 12Q also includes a secondary diamond table 12Q2 mounted so that it cuts earth formation when the bit is rotated so that the special cutting element 12Q moves in a direction opposite the rotation of the bit. This occurs, as previously explained, when the bit is rotated inside an opening having about the pass-through diameter, or about the pass through axis. Special cutting elements such as shown at 12Q in FIG. 10 may be affixed to any one or more cutting element positions on the blades proximate the line (10C in FIG. 8).

Figure 11:
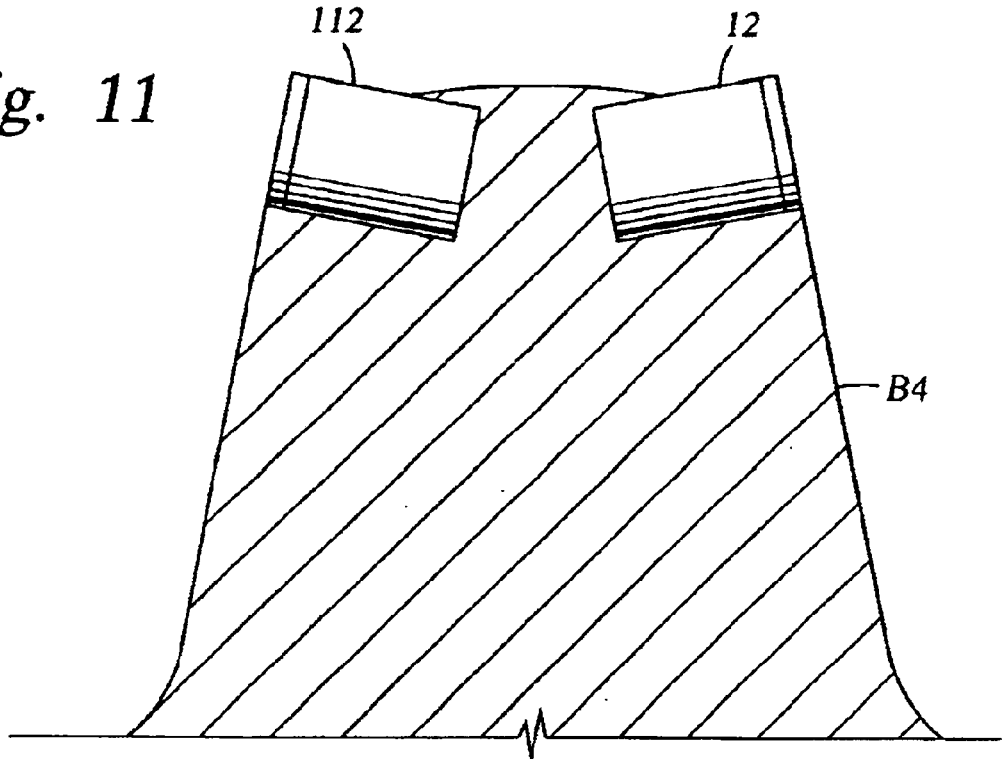
FIG. 11 shows a cross section of an example blade on a bi-center bit having a cutter mounted in a reverse direction.

An alternative to the special cutting element (12Q in FIG. 10) is shown in FIG. 11, which shows a cross-section of one of the blades B4 that extends to a position proximate the line (10C in FIG. 8). The blade B4 includes at least one cutting element or cutter 112 proximate the line (10C in FIG. 8) oriented to cut earth formation when the portion of the blade B4 proximate the line reverse rotates during casing drill out. For ordinary drilling where the bit rotates about its longitudinal axis (24 in FIG. 8), the blade B4 preferably includes at least one normally-oriented cutter 12 proximate the line (10C in FIG. 8). The normally oriented cutter 12 cuts earth formation during rotation in the same direction as the rotation of the bit.

Figure 12:
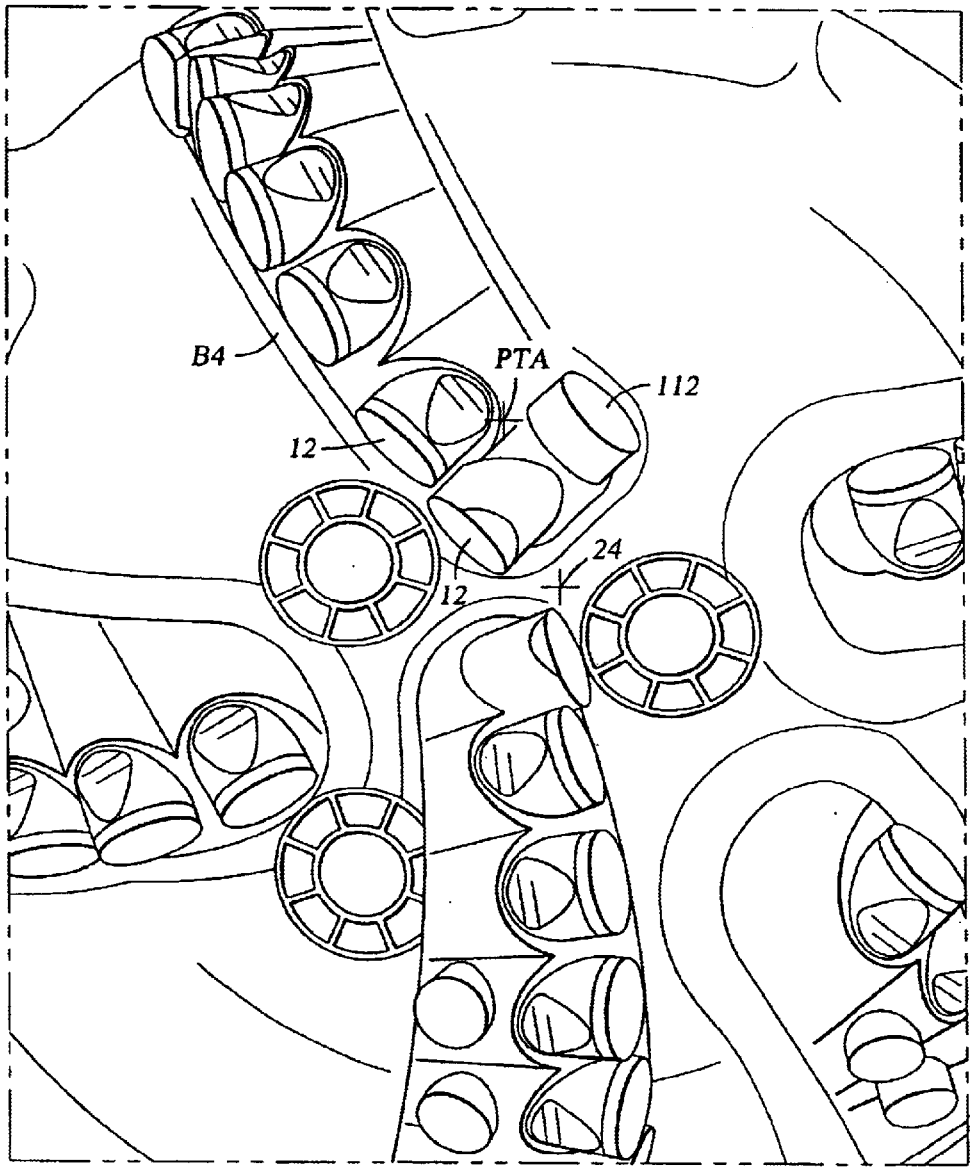
FIG. 12 shows a plan view of a pilot section on a bi-center bit having a blade as shown in cross-section in FIG. 11.

The arrangement of the at least one reverse-oriented cutter 112 and normally oriented cutter 12 shown in cross section in FIG. 11 is shown in plan or end view in FIG. 12 to illustrate a preferred placement of the at least one reverse-oriented cutter 112 and the normally oriented cutter 12. A bit made according to the present aspect of the invention may have better performance during casing drill out.

Figure 9:
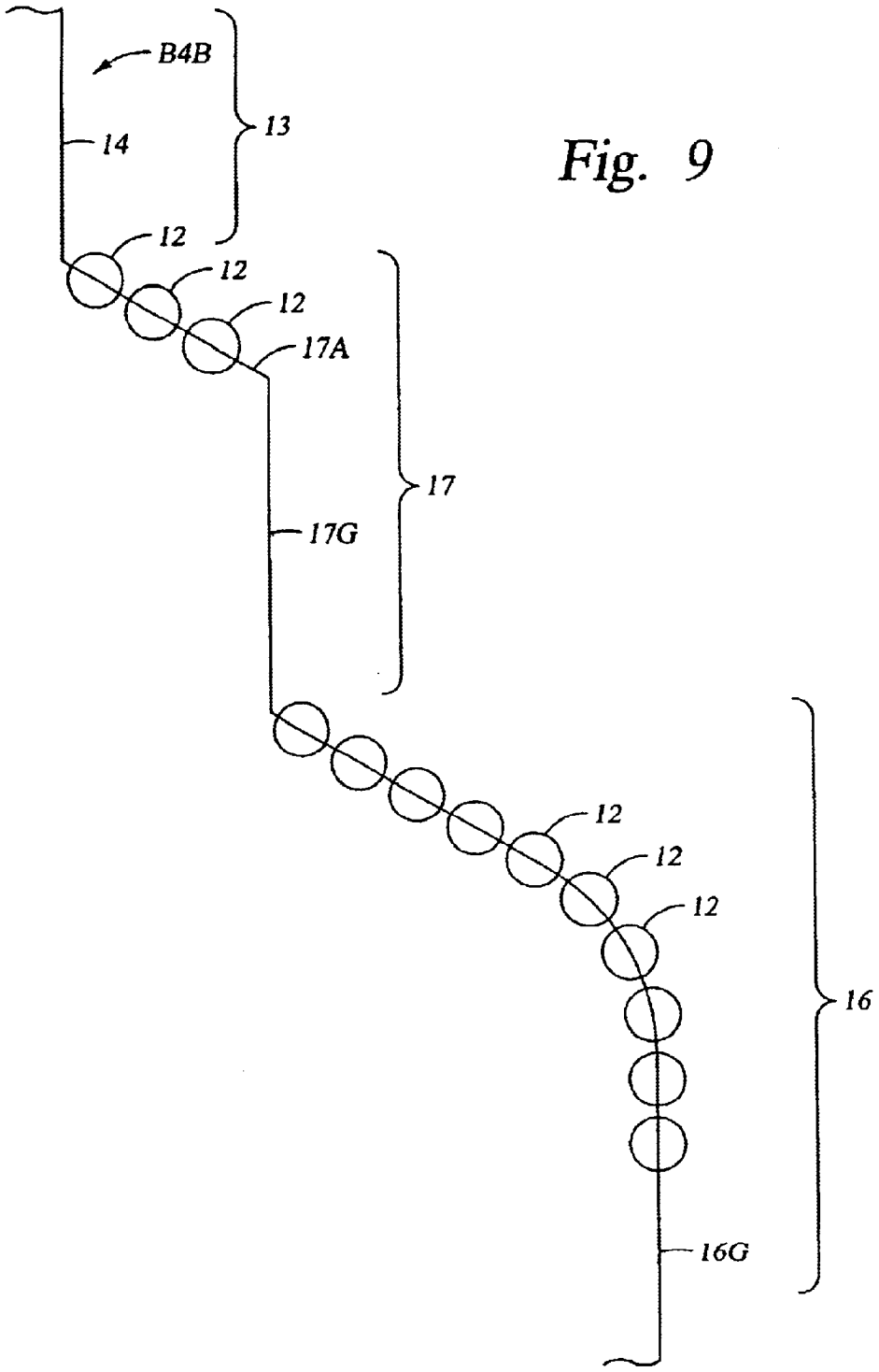
FIG. 9 shows a profile view of a blade structure including one embodiment of an aspect of the invention called a pilot hole conditioning section.

Another aspect of the invention can improve the ability of a bi-center drill bit to maintain drilling direction when used in directional drilling applications. FIG. 9 shows a cross section of an example blade structure, extending from the pilot section 13 to the reaming section 16 thereof. The blade in this example is one of the blades which is disposed in the arcuate section (A–B in FIG. 4), for example B4A in FIG. 8. It should be understood that any one of the blades on a bi-center bit may include a structure such as shown in cross section in FIG. 9. The blade B4B shown in cross section FIG. 9 includes a tapered face 17A and a gage face 17G. Preferably at least one, and more preferably a plurality of cutting elements 12, which may be PDC cutters as are the other cutting elements on the bit, are disposed on the tapered face 17A. The intermediate diameter gage face 17G is disposed below the tapered face 17A and may include thereon any form of gage protection (not shown) known in the art, or may include at least one cutting element (not shown in this example) disposed at an intermediate gage diameter defined by the gage face 17G. Preferably, the tapered face 17A, having cutting elements 12 thereon, and the intermediate diameter gage face 17G are included on a plurality of the blades azimuthally distributed around the circumference of the drill bit. The longitudinal position of the tapered face 17A and gage face 17G is generally between the pilot section 13 and the reaming section 16. Preferably the tapered face 17A and gage face 17G are formed into the same blade structure as selected ones of the pilot blades 14 or reaming blades 16, but this is not intended to be a limitation on the invention. In combination, the intermediate diameter gage faces 17G, and in the embodiment of FIG. 9 the tapered faces 17A, distributed azimuthally around the bit, form a pilot hole conditioning section 17 disposed longitudinally between the pilot section 13 and the reaming section 16 on the bi-center bit. Having a pilot hole conditioning section 17 such as shown in FIG. 9 may improve the ability of a bi-center bit to "hold angle" or otherwise maintain intended wellbore trajectory when used in directional drilling applications.

It should also be understood that other embodiments of a pilot hole conditioning section may not require a tapered face on any one or all of the blades. It is only required in this aspect of the invention that blades, or a portion thereof, distributed around the circumference of the bit define an intermediate gage diameter. The tapered face 17A in the embodiment of FIG. 9 is only to provide a convenient form of transition between the pilot hole diameter and the intermediate diameter. Accordingly, other embodiments of a pilot hole conditioning section may include blade profiles other than the one shown in FIG. 9. Additionally, the gage faces 17G need not be formed integrally with the blade structure of either the pilot blades or the reaming blades as shown in FIG. 9. In other embodiments, the gage faces 17G may be formed as separate structures.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A bi-center drill bit, comprising:

a bit body having pilot blades and reaming blades thereon distributed azimuthally around the bit body, selected ones of the blades having cutting elements thereon at selected locations, wherein selected azimuthally corresponding ones of the pilot blades and the reaming blades are formed into unitized spiral structures, the bit comprising, longitudinally between the pilot blades and the reaming blades, a pilot hole conditioning section comprising a plurality of gage faces, the gage faces defining a diameter intermediate a pilot hole diameter and a pass-through diameter defined respectively by the pilot blades and the reaming blades, the bit further comprising at least one tapered face intermediate the pilot blades and the gage faces.

2. The bi-center drill bit as defined in claim 1 wherein at least one of the gage faces has at least one cutting element disposed thereon.

3. The bi-center bit as defined in claim 1 wherein the at least one tapered face includes at least one cutting element mounted thereon.

4. The bi-center bit of claim 1 further comprising at least one bidirectional cutting element attached to one of the blades proximate a line extending between a longitudinal axis of the bit and a pass through axis of the bit, the bidirectional cutting element comprising a primary cutting surface oriented to cut earth formation when the bidirectional cutting element moves along the direction of rotation of the bit, the bidirectional cutting element comprising a secondary cutting surface oriented to cut earth formation when the bidirectional cutting element moves opposite the direction of rotation of the bit.

5. The bi-center bit as defined in claim 1 further comprising at least one cutting element attached to one of the blades proximate a line between a longitudinal axis of the bit and a pass through axis of the bit, the at least one cutting element oriented to cut earth formation when the at least one cutting element moves opposite a direction of rotation of the bit.

6. The bi-center drill bit as defined in claim 1 wherein positions for the cutting elements are selected so that lateral forces exerted by said cutting elements disposed on the pilot blades and the reaming blades are balanced as a single structure.

7. The bi-center drill bit as defined in claim 6 wherein the lateral forces are balanced to less than about 10 percent of a total axial force exerted on the bit.

8. The bi-center drill bit as defined in claim 6 wherein the lateral forces are balanced to less than about 5 percent of a total axial force exerted on the bit.

9. The bi-center drill bit as defined in claim 1 wherein a radially outermost surface of each of the reaming blades extends at most to a radially least extensive one, with respect to a longitudinal axis of the bit, of a pass-through circle and a drill circle, the drill circle substantially coaxial with the longitudinal axis, the pass-through circle axially offset from the drill circle and defining an arcuate section wherein the pass-through circle extends laterally from the longitudinal axis past a radius of the drill circle, so that radially outermost cutting elements disposed on the reaming blades drill a hole having a drill diameter substantially twice a maximum lateral extension of the reaming blades from the longitudinal axis while substantially avoiding wall contact along an opening having a diameter of the pass through circle.

10. The bi-center drill bit as defined in claim 1 wherein at least one jet is disposed proximate to the reaming blades, the at least one jet oriented so that its axis is within approximately 30 degrees of a line normal to a longitudinal axis of the bit.

11. The bi-center drill bit as defined in claim 1 wherein at least one jet is disposed proximate to the reaming blades, the at least one jet oriented so that its axis is within approximately 20 degrees of a line normal to a longitudinal axis of the bit.

12. The bi-center drill bit as defined in claim 1 wherein a center of mass of the bit is located within about 2.5 percent of a diameter of the bit from a longitudinal axis of the bit.

13. The bi-center drill bit as defined in claim 1 wherein a center of mass of the bit is located within about 1.5 percent of a diameter of the bit from a longitudinal axis of the bit.

14. A bi-center drill bit, comprising:

a bit body having pilot blades and reaming blades thereon distributed azimuthally around the body, selected ones of the blades having cuffing elements thereon at selected locations, the body and blades defining a longitudinal axis of the bit and a pass-through axis of the bit; and at least one bidirectional cutting element attached proximate a line extending between the pass-through axis and the longitudinal axis, the bidirectional cutting element comprising a primary cutting surface oriented to cut earth formation when the bidirectional cutting element moves along the direction of rotation of the bit, the bidirectional cuffing element comprising a secondary cutting surface oriented to cut earth formation when the bidirectional cutting element moves opposite the direction of rotation of the bit.

15. The bi-center drill bit as defined in claim 14 wherein selected azimuthally corresponding ones of the pilot blades and the reaming blades are formed into unitized spiral structures.

16. The bi-center drill bit as defined in claim 14 wherein positions for the cutting elements are selected so that lateral forces exerted by said cutting elements disposed on the pilot blades and the reaming blades are balanced as a single structure.

17. The bi-center drill bit as defined in claim 16 wherein the lateral forces are balanced to less than about 10 percent of a total axial force exerted on the bit.

18. The bi-center drill bit as defined in claim 16 wherein the lateral forces are balanced to less than about 5 percent of a total axial force exerted on the bit.

19. The bi-center drill bit as defined in claim 14 wherein a radially outermost surface of each of the reaming blades extends at most to a radially least extensive one, with respect to the longitudinal axis, of a pass-through circle and a drill circle, the drill circle substantially coaxial with the longitudinal axis, the pass-through circle axially offset from the drill circle and defining an arcuate section wherein the pass-through circle extends laterally from the longitudinal axis past a radius of the drill circle, so that radially outermost cuffing elements disposed on the reaming blades drill a hole having a drill diameter substantially twice a maximum lateral extension of the reaming blades from the longitudinal axis while substantially avoiding wall contact along an opening having a diameter of the pass through circle.

20. The bi-center drill bit as defined in claim 14 wherein at least one jet disposed proximate to the reaming blades is oriented so that its axis is within approximately 30 degrees of a line normal to the longitudinal axis of said bit.

21. The bi-center drill bit as defined in claim 14 wherein at least one jet disposed proximate to the reaming blades is oriented so that its axis is within approximately 20 degrees of a line normal to the longitudinal axis of said bit.

22. The bi-center drill bit as defined in claim 14 wherein a center of mass of the bit is located within about 2.5 percent of a diameter of the bit from the longitudinal axis.

23. The bi-center drill bit as defined in claim 14 wherein a center of mass of the bit is located within about 1.5 percent of a diameter of the bit from the longitudinal axis.

24. The bi-center drill bit as defined in claim 14 further comprising, longitudinally between the pilot blades and the reaming blades, a pilot hole conditioning section comprising a plurality of gage faces, the gage faces defining a diameter intermediate a pilot hole diameter and a pass-through diameter defined respectively by the pilot blades and the reaming blades.

25. The bi-center drill bit as defined in claim 24 wherein at least one of the gage faces has at least one cutting element disposed thereon.

26. The bi-center drill bit as defined in claim 24 further comprising at least one tapered face intermediate the pilot blades and the gage faces.

27. The bi-center bit as defined in claim 26 wherein the at least one tapered face includes at least one cutting element thereon.

28. A bi-center drill bit, comprising:

a bit body having pilot blades and reaming blades thereon distributed azimuthally around the body, selected ones of the blades having cutting elements thereon at selected locations, the body and blades defining a longitudinal axis of the bit and a pass-through axis of the bit; and at least one reverse oriented cutting element attached proximate a line extending between the pass-through axis and the longitudinal axis, the at least one reverse oriented cutting element oriented to cut earth formation when the reverse oriented cutting element moves opposite a direction of rotation of the bit.

29. The bi-center drill bit as defined in claim 28 further comprising, longitudinally between the pilot blades and the reaming blades, a pilot hole conditioning section comprising a plurality of gage faces, the gage faces defining a diameter intermediate a pilot hole diameter and a pass-through diameter defined respectively by the pilot blades and the reaming blades.

30. The bi-center drill bit as defined in claim 28 wherein at least one of the gage faces has at least one cuffing element disposed thereon.

31. The bi-center drill bit as defined in claim 28 further comprising at least one tapered face intermediate the pilot blades and the gage faces.

32. The bi-center bit as defined in claim 31 wherein the at least one tapered face includes at least one cuffing element thereon.

33. A The bi-center drill bit as defined in claim 28 wherein selected azimuthally corresponding ones of the pilot blades and the reaming blades are formed into unitized spiral structures.

34. The bi-center drill bit as defined in claim 28 wherein positions for the cuffing elements are selected so that lateral forces exerted by said cutting elements disposed on the pilot blades and the reaming blades are balanced as a single structure.

35. The bi-center drill bit as defined in claim 34 wherein the lateral forces are balanced to less than about 10 percent of a total axial force exerted on the bit.

36. The bi-center drill bit as defined in claim 34 wherein the lateral forces are balanced to less than about 5 percent of a total axial force exerted on the bit.

37. The bi-center drill bit as defined in claim 28 wherein a radially outermost surface of each of the reaming blades extends at most to a radially least extensive one, with respect to the longitudinal axis, of a pass-through circle and a drill circle, the drill circle substantially coaxial with the longitudinal axis, the pass-through circle axially offset from the drill circle and defining an arcuate section wherein the pass-through circle extends laterally from the longitudinal axis past a radius of the drill circle, so that radially outermost cutting elements disposed on the reaming blades drill a hole having a drill diameter substantially twice a maximum lateral extension of the reaming blades from the longitudinal axis while substantially avoiding wall contact along an opening having a diameter of the pass through circle.

38. The bi-center drill bit as defined in claim 28 wherein at least one jet disposed proximate to the reaming blades is oriented so that its axis is within approximately 30 degrees of a line normal to the longitudinal axis of said bit.

39. The bi-center drill bit as defined in claim 28 wherein at least one jet disposed proximate to the reaming blades is oriented so that its axis is within approximately 20 degrees of a line normal to the longitudinal axis of said bit.

40. The bi-center drill bit as defined in claim 28 wherein a center of mass of the bit is located within about 2.5 percent of a diameter of the bit from the longitudinal axis.

41. The bi-center drill bit as defined in claim 28 wherein a center of mass of the bit is located within about 1.5 percent of a diameter of the bit from the longitudinal axis.

* * * * *